US009140223B2

(12) United States Patent
Ricco et al.

(10) Patent No.: US 9,140,223 B2
(45) Date of Patent: Sep. 22, 2015

(54) FUEL INJECTION SYSTEM WITH HIGH REPEATABILITY AND STABILITY OF OPERATION FOR AN INTERNAL-COMBUSTION ENGINE

(75) Inventors: Mario Ricco, Lotto (IT); Sergio Stucchi, S.P. Casamassima (IT); Raffaele Ricco, S.P. Casamassima (IT); Onofrio De Michele, S.P. Casamassima (IT); Chiara Altamura, S.P. Casamassima (IT); Domenico Lepore, S.P. Casamassima (IT)

(73) Assignee: C.R.F. Societá Consortile per Azioni (IT)

( * ) Notice: Subject to any disclaimer, the term of this patent is extended or adjusted under 35 U.S.C. 154(b) by 1044 days.

(21) Appl. No.: 12/624,200

(22) Filed: Nov. 23, 2009

(65) Prior Publication Data

US 2010/0186708 A1 Jul. 29, 2010

(30) Foreign Application Priority Data

Dec. 29, 2008 (EP) ..... 08425817

(51) Int. Cl.
*F02M 45/08* (2006.01)
*F02M 47/02* (2006.01)
(Continued)

(52) U.S. Cl.
CPC ..... *F02M 47/027* (2013.01); *F02M 63/004* (2013.01); *F02M 63/007* (2013.01);
(Continued)

(58) Field of Classification Search
CPC ..... F02M 2200/306; F02M 45/08; F02M 63/0075; Y01S 239/90
USPC ..... 123/299, 472, 490; 239/90, 533.2, 239/585.2, 585.3, 900; 251/129.19, 50, 251/129.16
See application file for complete search history.

(56) References Cited

U.S. PATENT DOCUMENTS 4,280,497 A 7/1981 Warner et al.
4,496,361 A 1/1985 Kilkson
(Continued)

FOREIGN PATENT DOCUMENTS

CN 1119885 A 4/1996
CN 1982685 A 6/2007
(Continued)

OTHER PUBLICATIONS

"European Application Serial No. 08425817.7, European Search Report mailed Jun. 2, 2009", 4 pgs.
(Continued)

*Primary Examiner* — Mahmoud Gimie
*Assistant Examiner* — David Hamaoui
(74) *Attorney, Agent, or Firm* — Schwegman Lundberg & Woessner, P.A.

(57) ABSTRACT

The fuel injection system comprises a fuel injector controlled by commands of a control unit. The fuel injector comprises a metering servo valve having a control chamber provided with an outlet passage that is opened/closed by an open/close element that is axially movable. The open/close element is carried by an axial guide element that is separate from an armature of an electromagnet. The open/close element is held in the closing position by a spring acting through an intermediate body. In some instances, the strokes of the open/close element and of the armature are chosen so as to eliminate, upon closing of the servo valve, the rebounds of the open/close element subsequent to the first rebound. The control unit controls a fuel injection comprising a pilot fuel injection and a main fuel injection, via two distinct electrical commands, which are spaced apart by a dwell time such as to occur in an area of reduced variation of the amount of injected fuel. Therefore, the stability of operation of the fuel injection system increases as the dwell time varies.

14 Claims, 12 Drawing Sheets

(51) Int. Cl.

| | |
|---|---|
| *F02M 63/00* | (2006.01) |
| *F02D 41/20* | (2006.01) |
| *F02D 41/40* | (2006.01) |

(52) U.S. Cl.

CPC ..... *F02M63/008* (2013.01); *F02M 63/0024* (2013.01); *F02D 41/20* (2013.01); *F02D 41/403* (2013.01); *F02M 45/08* (2013.01); *F02M 63/0075* (2013.01); *F02M 2200/306* (2013.01); *F02M 2547/003* (2013.01)

(56) References Cited

U.S. PATENT DOCUMENTS

| | | | | |
|---|---|---|---|---|
| 4,588,401 | A | 5/1986 | Kilkson | |
| 4,670,013 | A | 6/1987 | Barnes et al. | |
| 4,695,460 | A | 9/1987 | Holme | |
| 4,828,976 | A | 5/1989 | Murphy | |
| 4,992,363 | A | 2/1991 | Murphy | |
| 5,139,224 | A * | 8/1992 | Bright | 251/50 |
| 5,147,776 | A | 9/1992 | Koerner | |
| 5,203,538 | A * | 4/1993 | Matsunaga et al. | 251/129.19 |
| 5,248,506 | A | 9/1993 | Holme et al. | |
| 5,250,303 | A | 10/1993 | Meryman et al. | |
| 5,299,776 | A | 4/1994 | Brinn, Jr. et al. | |
| 5,487,971 | A | 1/1996 | Holme et al. | |
| 5,499,608 | A | 3/1996 | Meister et al. | |
| 5,569,579 | A | 10/1996 | Murphy | |
| 6,109,541 | A * | 8/2000 | Beatty et al. | 239/88 |
| 6,162,396 | A | 12/2000 | Bitensky et al. | |
| 6,279,542 | B1 | 8/2001 | Lindblom | |
| 6,279,843 | B1 | 8/2001 | Coldren et al. | |
| 6,305,355 | B1 | 10/2001 | Hoffmann et al. | |
| 6,390,069 | B1 | 5/2002 | Jiang et al. | |
| 6,413,200 | B1 | 7/2002 | Jorgensen et al. | |
| 6,415,762 | B1 | 7/2002 | Hafner et al. | |
| 6,450,424 | B1 * | 9/2002 | Horbelt | 239/585.1 |
| 6,468,732 | B1 | 10/2002 | Malin et al. | |
| RE38,203 | E | 7/2003 | Kelly | |
| 6,730,267 | B2 | 5/2004 | Stringer et al. | |
| 6,764,061 | B2 * | 7/2004 | Haeberer et al. | 251/129.16 |
| 6,793,158 | B2 | 9/2004 | Ricco | |
| 6,796,543 | B2 * | 9/2004 | Haeberer et al. | 251/50 |
| 6,828,090 | B2 | 12/2004 | Lucas et al. | |
| 7,111,613 | B1 | 9/2006 | Barnes et al. | |
| 7,131,428 | B2 * | 11/2006 | Ricco et al. | 123/478 |
| 7,202,020 | B2 | 4/2007 | Lucas et al. | |
| 7,240,859 | B2 * | 7/2007 | Ricco et al. | 239/585.1 |
| 7,241,282 | B2 | 7/2007 | Stossel et al. | |
| 7,252,245 | B2 | 8/2007 | Nishiwaki | |
| 7,360,528 | B2 * | 4/2008 | Ricco et al. | 123/500 |
| 7,422,166 | B2 * | 9/2008 | Hoffmann et al. | 239/585.2 |
| 7,574,297 | B2 | 8/2009 | Pauer | |
| 7,588,016 | B2 | 9/2009 | Pauer | |
| 7,707,993 | B2 | 5/2010 | Coldren et al. | |
| 7,963,270 | B2 * | 6/2011 | Ricco et al. | 123/472 |
| 7,964,338 | B2 | 6/2011 | Sehgal et al. | |
| 8,037,869 | B2 * | 10/2011 | Ricco et al. | 123/472 |
| 8,178,318 | B2 | 5/2012 | Cheng et al. | |
| 8,316,826 | B2 * | 11/2012 | Coldren et al. | 123/490 |
| 2003/0056761 | A1 | 3/2003 | Yomogida et al. | |
| 2003/0127532 | A1 | 7/2003 | Coldren et al. | |
| 2004/0108394 | A1 | 6/2004 | Lawrence et al. | |
| 2004/0185036 | A1 | 9/2004 | Stossel et al. | |
| 2005/0019743 | A1 | 1/2005 | Wagner et al. | |
| 2005/0269432 | A1 | 12/2005 | Nishiwaki | |
| 2006/0202145 | A1 | 9/2006 | Ricco et al. | |
| 2006/0284129 | A1 | 12/2006 | Krishnaswamy et al. | |
| 2007/0028895 | A1 | 2/2007 | Fujii | |
| 2008/0199845 | A1 | 8/2008 | Rosiello et al. | |
| 2008/0233554 | A1 | 9/2008 | Sehgal et al. | |
| 2009/0074737 | A1 | 3/2009 | Rosiello et al. | |
| 2009/0155763 | A1 | 6/2009 | Rosiello et al. | |
| 2009/0191537 | A1 | 7/2009 | Mayaudon et al. | |
| 2009/0253115 | A1 | 10/2009 | Sehgal et al. | |
| 2009/0263781 | A1 | 10/2009 | Sehgal et al. | |
| 2009/0314860 | A1 | 12/2009 | Wang et al. | |
| 2010/0162992 | A1 * | 7/2010 | Ricco et al. | 123/299 |
| 2010/0292200 | A1 | 11/2010 | Kile et al. | |
| 2011/0189151 | A1 | 8/2011 | Stossel et al. | |
| 2011/0223579 | A1 | 9/2011 | Sehgal | |
| 2012/0024156 | A1 | 2/2012 | Yoshida et al. | |
| 2012/0058558 | A1 | 3/2012 | Sehgal | |
| 2012/0107791 | A1 | 5/2012 | Rosiello et al. | |
| 2012/0225044 | A9 | 9/2012 | Rosiello et al. | |

FOREIGN PATENT DOCUMENTS

| | | | |
|---|---|---|---|
| DE | 19636088 | A1 | 3/1998 |
| DE | 19809001 | A1 | 9/1998 |
| DE | 102004050992 | A1 | 4/2006 |
| EP | 0114372 | A2 | 8/1984 |
| EP | 0142339 | A1 | 5/1985 |
| EP | 330151 | A2 | 8/1989 |
| EP | 0387700 | A1 | 9/1990 |
| EP | 494957 | A1 | 7/1992 |
| EP | 0281621 | B1 | 3/1993 |
| EP | 649311 | A1 | 4/1995 |
| EP | 684762 | A1 | 12/1995 |
| EP | 0510185 | B1 | 12/1996 |
| EP | 775009 | A1 | 5/1997 |
| EP | 786934 | A2 | 8/1997 |
| EP | 853881 | A2 | 7/1998 |
| EP | 1302654 | A2 | 4/2003 |
| EP | 1344923 | A2 | 9/2003 |
| EP | 1161143 | B1 | 5/2004 |
| EP | 1657422 | A1 | 5/2006 |
| EP | 1707797 | A1 | 10/2006 |
| EP | 1795738 | A1 | 6/2007 |
| EP | 1918568 | A1 | 5/2008 |
| EP | 2077074 | A2 | 7/2009 |
| JP | 2003-269228 | A | 9/2003 |
| JP | 2006-017101 | A | 1/2006 |
| JP | 2006-097659 | A | 4/2006 |
| JP | 2006-258097 | A | 9/2006 |
| JP | 2007-162674 | A | 6/2007 |
| WO | WO-8401292 | A1 | 4/1984 |
| WO | WO-8502116 | A1 | 5/1985 |
| WO | WO-8705468 | A1 | 9/1987 |
| WO | WO-8801871 | A1 | 3/1988 |
| WO | WO-9104659 | A1 | 4/1991 |
| WO | WO-9208349 | A1 | 5/1992 |
| WO | WO-2006/042798 | A1 | 4/2006 |
| WO | WO-2011046841 | A1 | 4/2011 |

OTHER PUBLICATIONS

"U.S. Appl. No. 12/493,009, Non-Final Office Action mailed Jul. 23, 10", 9 pgs.

"Chinese Application Serial No. 200910260787.4, Office Action mailed Apr. 15, 2012", 7 pgs.

"Japanese Application Serial No. 2009-291996, Office Action mailed Jan. 8, 2013", (English Translation), 10 pgs.

"Machine Translation of JP 2006-097659A published Apr. 13, 2006", (Translation of Description), 2 pgs.

* cited by examiner

FUEL INJECTION SYSTEM WITH HIGH REPEATABILITY AND STABILITY OF OPERATION FOR AN INTERNAL-COMBUSTION ENGINE

RELATED APPLICATION

This application claims the benefit of priority, under 35 U.S.C. Section 119, to European Patent Application Serial No. 08425817.7 filed on Dec. 29, 2008, which is incorporated herein by reference in its entirety.

TECHNICAL FIELD

The present invention relates to a fuel injection system with high operation repeatability and stability for an internal combustion engine.

BACKGROUND

Normally, fuel injection systems comprise at least one fuel injector controlled by a metering servo valve, which comprises a control chamber supplied with pressurized fuel. An outlet passage of the control chamber is normally kept closed by an open/close element via elastic means. The open/close element is actuated for opening the servo valve, by an armature of an electric actuator acting in opposition to the elastic means, for controlling an injection of fuel. The fuel injection system also comprises a unit for controlling the electric actuator, which is designed to issue for each fuel injection a corresponding electrical command.

In order to improve the performance of the engine, from EP1795738, a fuel injection system is known in which, for each fuel injection in a cylinder of the engine, the control unit issues at least one first electrical command of a pre-set duration for generating a pilot fuel injection, and a subsequent electrical command of duration corresponding to the operating conditions of the engine for controlling a main fuel injection. In some examples, the two commands are separated by a time interval such that the main fuel injection starts without a solution of continuity with the pilot fuel injection, i.e., such that the diagram of the supply of fuel during the fuel injection phase or event will assume a humped profile. In some examples, the two commands are separated by a time interval such that the main fuel injection starts without any solution of continuity with the pilot fuel injection, i.e., such that the diagram of the supply of fuel during the fuel injection phase or event will assume a humped profile.

Given the same duration of the electrical commands for the actuation of the pilot fuel injection and of the main fuel injection, the total amount of fuel introduced into the combustion chamber via the pilot fuel injection and the main fuel injection varies as a function of the time interval between the two aforesaid commands issued by the control unit. In particular, it is possible to identify two different modes of behaviour of the injector as a function of the time interval that elapses between the command for the pilot fuel injection and the command for the main fuel injection. In fact, it is possible to identify a limit value for said interval, above which the amount of fuel injected during the main fuel injection depends, not only upon the duration of the electrical command, but also upon the oscillations of pressure that are set up in the intake duct from the rail to the injector, on account of the pilot fuel injection.

For durations of the interval between the two fuel injections shorter than this limit value, instead, the amount of fuel introduced during the main fuel injection is affected by numerous factors, among which the duration itself of said interval, the train of rebounds of the open/close element, the evolution of the fuel pressure in the control chamber, the position of the needle of the nebulizer at the instant of start of the command for the main fuel injection and again the fluid-dynamic conditions that are set up in the proximity of the sealing area. In addition, the state of ageing of the injector, insofar as the wear of the parts in fluid-tight contact or in mutual motion, with extremely small coupling play, significantly affects the mode of rebound of the open/close element.

This phenomenon is substantially due to the presence of the pilot fuel injection, which in effect alters the fluid-dynamic conditions of the injector at the moment of the command for the main fuel injection. In particular, the limit value of the duration of the interval that separates these two modes of behaviour is approximately 300 μs.

In addition, the robustness of operation of the injector is markedly jeopardized when the time interval between the commands of the two fuel injections occurs below the limit value defined previously, and in particular when said interval becomes very small so that the pilot fuel injection interferes to a greater extent with the subsequent main fuel injection.

Notwithstanding the fact that it is possible to program the control unit so as to vary this interval between the pilot fuel injection and the main fuel injection during the service life of the injector, it remains in any case impossible to predetermine the degree of the correction to be introduced to cause the profile of the two fuel injections to continue to be humped.

The drawback encountered in the known fuel injection systems of the type described is due to the fact that, in order to obtain an injection profile of the humped type, it is necessary to set a value of the interval between the pilot fuel injection and the main fuel injection that is very small. Consequently, the start of re-opening of the servo valve for the main fuel injection occurs when the injection dynamics of the injected fuel is markedly variable and dependent upon the parameters set forth previously, with deleterious effects on the efficiency of the engine and on the pollutant emissions of the exhaust gases. These drawbacks increase rapidly following upon wear of the parts of the servo valve.

SUMMARY

The aim of the examples disclosed herein is to provide a fuel injection system with high operation repeatability and stability over time, eliminating the drawbacks of fuel injection systems of the known art.

According to several examples, the above purpose is achieved by a fuel injection system with high operation repeatability and stability for an internal combustion engine, as claimed in the attached Claims.

BRIEF DESCRIPTION OF THE DRAWINGS

For a better understanding, some embodiments are described herein, purely by way of example with the aid of the annexed drawings, wherein.

DETAILED DESCRIPTION

Figure 1:
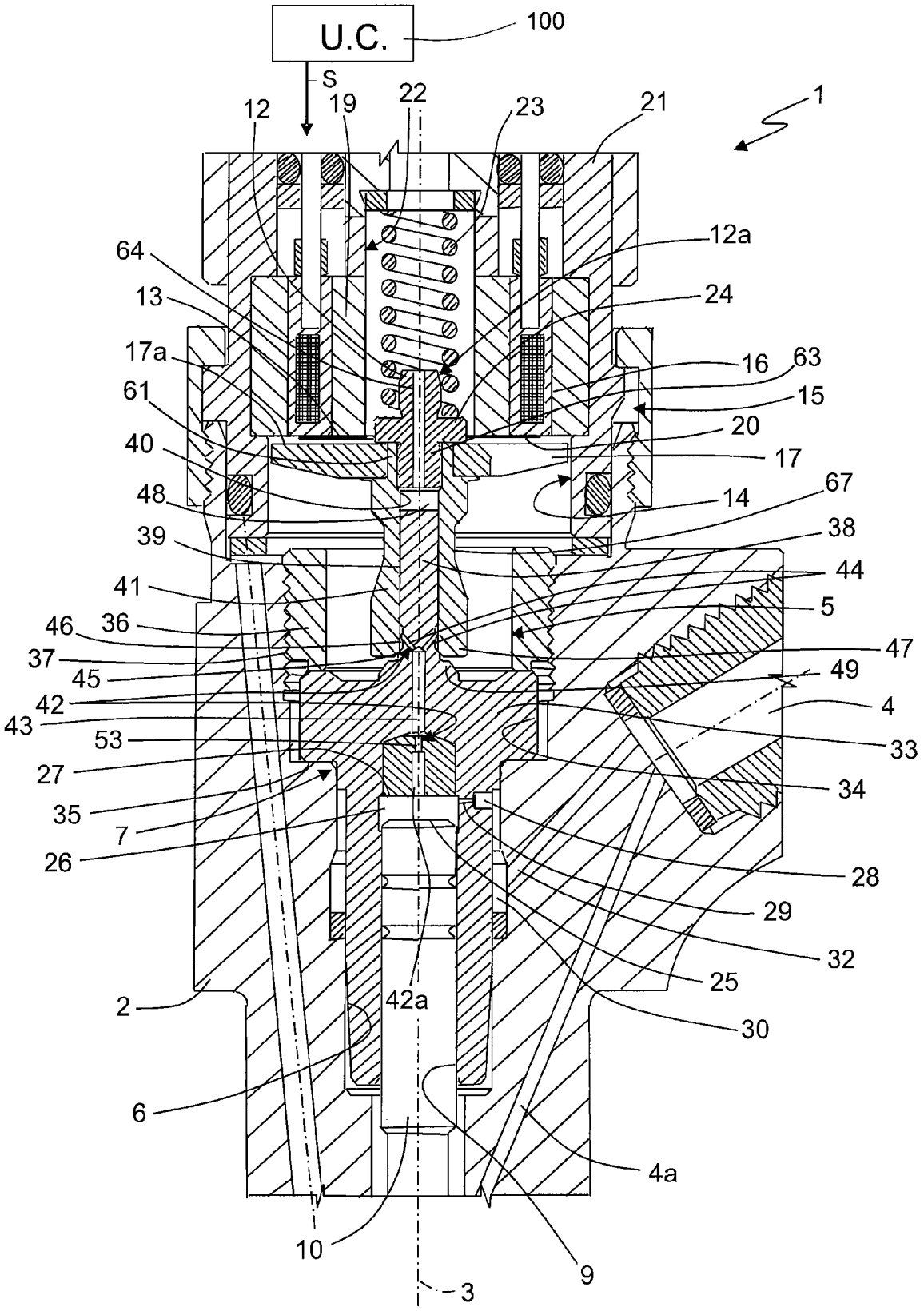
FIG. 1 is a partial vertical section of a fuel injector for a fuel injection system for an internal combustion engine, according to some examples.

With reference to FIG. 1, a fuel injector for an internal combustion engine, in particular a diesel engine, is designated as a whole by 1. The fuel injector 1 comprises a hollow body or casing 2, which extends along a longitudinal axis 3, and has a side inlet 4 designed to be connected to a duct for intake of the fuel at high pressure, for example, at a pressure in the region of 1800 bar. The casing 2 terminates with a nozzle, or nebulizer, for injection of the fuel at high pressure (not visible in the figures), which is in communication with the inlet 4, through a duct 4*a*.

The casing 2 has an axial cavity 6, in which is housed a metering servo valve 5, which comprises a valve body 7 having an axial hole 9. A rod 10 is axially slidable in the hole 9, in a fluid-tight way for the pressurized fuel, for control of the injection. The casing 2 is provided with another cavity 14 housing an electric actuator 15, which comprises an electromagnet 16 designed to control an armature 17 in the form of a notched disk. The fuel injection system comprises an electronic unit 100 for controlling the electromagnet 16, which is designed to supply for each fuel injection a corresponding electrical command S. In particular, the electromagnet 16 comprises a magnetic core 19, which has a polar surface 20 perpendicular to the axis 3, and is held in position by a support 21.

The electric actuator 15 has an axial discharge cavity 22 of the servo valve 5, housed in which are elastic means defined by a helical compression spring 23. The spring 23 is preloaded so as to push the armature 17 in a direction opposite to the attraction exerted by the electromagnet 16. The spring 23 acts on the armature 17 through an intermediate body, designated as a whole by 12*a*, which comprises engagement means formed by a flange 24 made of a single piece with a pin 12 for guiding one end of the spring 23. A thin lamina 13 made of non-magnetic material is located between a top plane surface 17*a* of the armature 17 and the polar surface 20 of the core 19, in order to guarantee a certain gap between the armature 17 and the core 19.

The valve body 7 comprises a chamber 26 for controlling metering of the fuel to be injected, which is delimited radially by the side surface of the hole 9. Axially the control chamber 26 is delimited by an end surface 25 shaped like a truncated cone (i.e., frustoconical) of the rod 10 and by an end wall 27 of the hole 9 itself. The control chamber 26 communicates permanently with the inlet 4, through a duct 32 made in the body 2, and an inlet duct 28 made in the valve body 7. The duct 28 is provided with a calibrated length or stretch 29, which leads into the control chamber 26 in the vicinity of the end wall 27. On the outside of the valve body 7, the inlet duct 28 leads into an annular chamber 30, into which the duct 32 also leads.

The valve body 7 moreover comprises a flange 33 housed in a portion 34 of the cavity 6, having an oversized diameter. The flange 33 is axially in contact, in a fluid-tight way, with a shoulder 35 of the cavity 6 via a threaded ring nut 36 screwed on an internal thread 37 of the portion 34 of the cavity 6. The armature 17 is associated to a bushing 41 guided axially by a guide element, formed by an axial stem 38, which is made of a single piece with the flange 33 of the valve body 7. The stem 38 extends in cantilever fashion from the flange 33 itself towards the cavity 22. The stem 38 has a cylindrical side surface 39, coupled in a substantially fluid-tight way to a cylindrical inner surface 40 of the bushing 41.

The control chamber 26 also has an outlet passage 42*a* for the fuel, having a restriction or calibrated length or stretch 53, which in general has a diameter comprised between 150 and 300 micrometers (μm). The outlet passage 42*a* is in communication with a discharge duct 42, made inside the flange 33 and the stem 38. The duct 42 comprises a blind axial length or stretch 43, having a diameter greater than that of the calibrated length or stretch 53, and at least one substantially radial length or stretch 44, in communication with the axial length or stretch 43. Advantageously, there may be provided two or more radial lengths or stretches 44, set at a constant angular distance, which give out into an annular chamber 46, formed by a groove of the side surface 39 of the stem 38. In FIG. 1, two lengths or stretches 44 are provided, inclined with respect to the axis 3, towards the armature 17.

The annular chamber 46 is made in an axial position adjacent to the flange 33 and is opened/closed by an end portion of the bushing 41, which forms an open/close element 47 for said annular chamber 46 and hence also for the radial lengths or stretches 44 of the duct 42. The open/close element 47 co-operates with a corresponding valve seat for closing the servo valve 5. In particular, the open/close element 47 terminates with a stretch having an inner surface shaped like a truncated cone 45 (FIG. 2) flared downwards and designed to stop against a connector shaped like a truncated cone 49 set between the flange 33 and the stem 38. The connector 49 has two portions of surface shaped like a truncated cone 49*a* and 49*b*, separated by an annular groove 50, which has a cross section substantially shaped like a right triangle in order to maintain a constant diameter of the profile of engagement of the surface shaped like a truncated cone 45 of the open/close element 47, even following upon wear.

The armature 17 is made of a magnetic material, and is constituted by a distinct piece, i.e., separate from the bushing 41. It has a central portion 56 having a plane bottom surface 57, and a notched annular portion 58, having a cross section flared outwards. The central portion 56 has an axial hole 59, by means of which the armature 17 engages with a certain radial play along an axial portion of the bushing 41.

Figure 2:
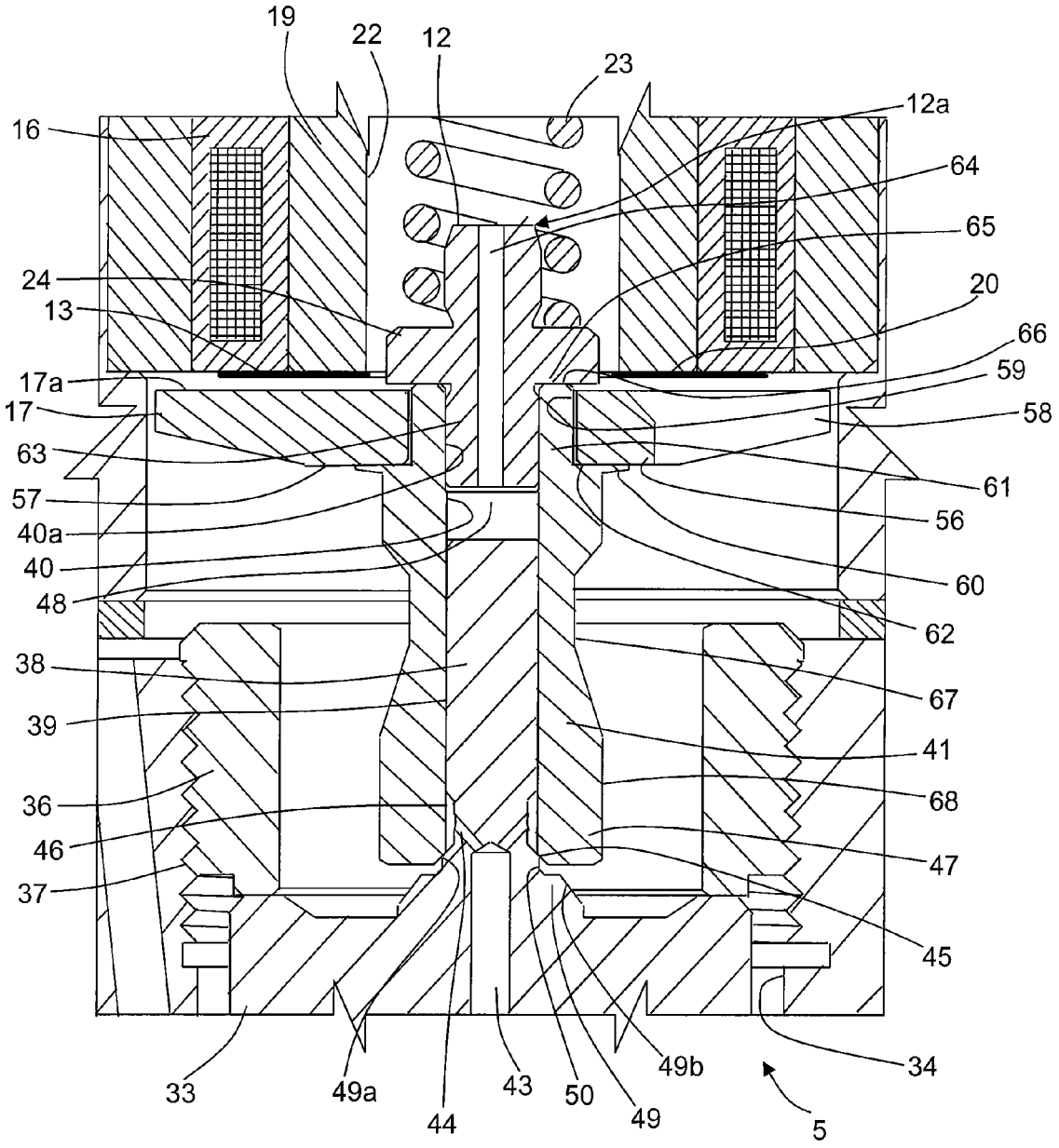
FIG. 2 is a detail of FIG. 1 at an enlarged scale.
Figure 3:
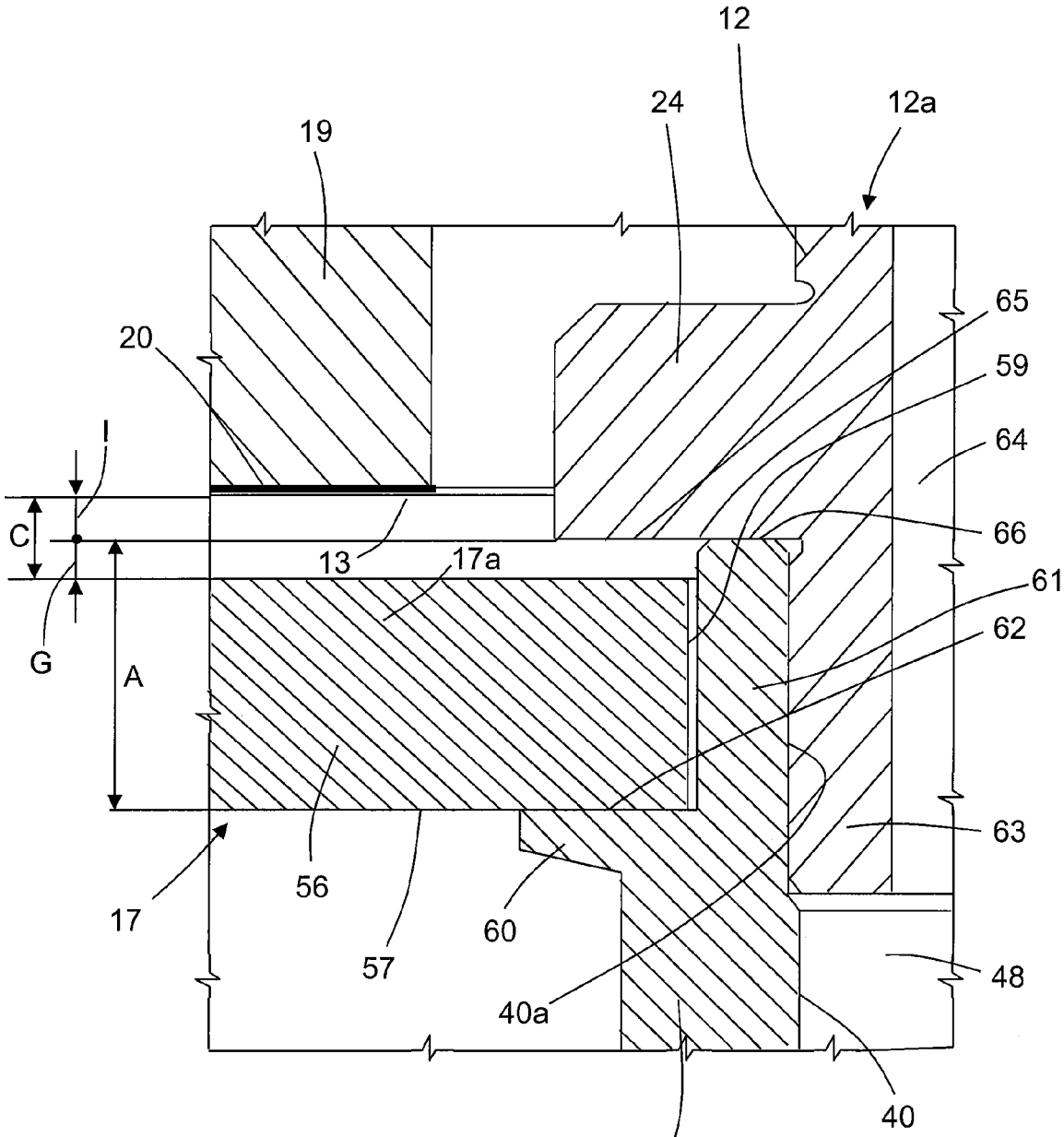
FIG. 3 is a portion of FIG. 2 at a further enlarged scale.

According to some examples, the axial portion of the bushing 41 has a projection designed to be engaged by the surface 57 of the armature 17 so as to enable the latter to perform an axial stroke greater than the stroke of the open/close element 47. In the embodiment of FIGS. 1-3 the axial portion of the bushing 41 is formed by a neck 61, made on a flange 60 of the bushing 41. The neck 61 has a smaller diameter than the bushing 41. The flange 24 is provided with a surface 65 designed to engage a surface 17*a* of the armature 17, opposite to the surface 57. The projection of the bushing 41 is constituted by a shoulder 62, formed between the neck 61 and the flange 60, and set in such a way as to create, between the plane surface 65 of the flange 24 and the surface 17*a* of the armature 17, an axial clearance G (FIG. 3) of a pre-set amount in order to enable a relative axial displacement between the armature 17 and the bushing 41.

In addition, the intermediate body 12*a* comprises an axial pin 63 for connection with the bushing 41, opposite to the pin 12, which is likewise made of a single piece with the flange 24 and is rigidly fixed to the bushing 41, in a corresponding seat 40*a* (FIG. 2). The seat 40*a* has a diameter slightly greater than the inner surface 40 of the bushing 41 so as to reduce the length of the surface 40 that is to be ground to provide a fluid-tight contact with the surface 39 of the stem 38. Between the surface 39 of the stem 38 and the surface 40 of the bushing 41, there is in general a certain leakage of fuel, which gives out into a compartment 48 between the end of the stem 39 and the connection pin 63. In order to enable discharge of the fuel that has leaked into the compartment 48 towards the cavity 22, the intermediate body 12*a* is provided with an axial hole 64.

The distance, or space between the surface 65 of the flange 24 and the shoulder 62 of the bushing 41 constitutes the housing A of the armature 17 (see also FIG. 3). The plane surface 65 of the flange 24 bears upon an end surface 66 of the neck 61 of the bushing 41 so that the housing A is uniquely defined. Between the shoulder 62 and the open/close element 47, the bushing 41 has an outer surface 68 having an intermediate portion 67 of a reduced diameter in order to reduce the inertia of the bushing 41.

Assuming that the lamina 13 is fixed with respect to the polar surface 20 of the core 19, when the bushing 41, through the intermediate body 12*a*, is held by the spring 23 in the closing position of the servo valve 5, the distance of the plane surface 17*a* from the lamina 13 constitutes the stroke or lift C of the armature 17, which is always greater than the clearance G of said armature 17 in its housing A. The armature 17 is found hence resting against the shoulder 62, in the position indicated in FIGS. 1-3, as will be seen more clearly in what follows. In actual fact, since the lamina 13 is non-magnetic, it could occupy axial positions different from the one described.

The stroke, or lift, I of opening of the open/close element 47 is equal to the difference between the lift C of the armature 17 and the clearance G. Consequently, the surface 65 of the flange 24 projects normally from the lamina 13 downwards by a distance equal to the lift I of the open/close element 47, along which the armature 17 draws the flange 24 upwards. The armature 17 can thus perform, along the neck 61, an over-stroke equal to said clearance G, in which the axial hole 59 of the armature 17 is guided axially by the neck 61.

Operation of a servo valve 5 of FIGS. 1-3 is described in what follows.

When the electromagnet 16 is not energized, by means of the spring 23 acting on the body 12*a*, the open/close element 47 is kept resting with its surface shaped like a truncated cone 45 against the portion shaped like a truncated cone 49*a* of the connector 49 so that the servo valve 5 is closed. Assume that, on account of the force of gravity and/or of the previous closing stroke, which will be seen hereinafter, the armature 17 is detached from the lamina 13 and rests against the shoulder 62. This does not affect, however, the effectiveness of operation of the servo valve 5 described in various examples, which is irrespective of the axial position of the armature 17 at the instant of energization of the electromagnet 16.

In the annular chamber 46 there has hence been set up a pressure of the fuel, the value of which is equal to the pressure of supply of the fuel injector 1. When the electromagnet 16 is energized to perform a step of opening of the servo valve 5, the core 19 attracts the armature 17, which at the start performs a loadless stroke, equal to the clearance G (FIG. 3), until it is brought into contact with the surface 65 of the flange 24, substantially without affecting the displacement of the bushing 41. Next, the action of the electromagnet 16 on the armature 17 overcomes the force of the spring 23 and, via the flange 24 and the fixing pin 63, draws the bushing 41 towards the core 19 so that the open/close element 47 opens the servo valve 5. Consequently, in this step, the armature 17 and the bushing 41 move jointly and traverse the stretch I of the entire stroke C allowed for the armature 17.

When energization of the electromagnet 16 ceases, the spring 23, via the body 12*a*, causes the bushing 41 to perform the stroke I towards the position of FIGS. 1-3 for closing the servo valve 5. During a first stretch of this closing stroke I, the flange 24, with the surface 65 draws the armature 17 along, which hence moves together with the bushing 41 and hence with the open/close element 47. At the end of the stroke I, the open/close element 47 impacts with its conical surface 45 against the portion of surface shaped like a truncated cone 49*a* of the connector 49 of the valve body 7.

On account of the type of stresses, the small area of contact, and the hardness of the open/close element 47 and of the valve body 7, after impact the open/close element 47 rebounds, overcoming the action of the spring 23. The rebound is favoured also because the impact occurs in the presence of a considerable amount of vapour of the fuel that had formed at a point corresponding to the open/close element as a result of the flow rate of fuel leaving the chamber 46. The degree of the vapour phase present depends markedly in a proportional way upon the value of the pressure in the control chamber 26 at the instant of cessation of the energization of the electromagnet 16. Consequently, the degree of the rebound is greater the shorter the duration of the command of energization for pilot fuel injections of a small amount.

If the armature 17 were fixed with respect to the bushing 41 in its travel towards the valve body 7, at the instant in which the first impact occurs, the open/close element 47 would reverse its direction of motion together with the armature 17, performing the first rebound of considerable amplitude, consequently determining re-opening of the servo valve 5 and delaying the displacement of the rod 10 with consequent delay of closing of the needle of the nebulizer. The spring 23 then pushes the bushing 41 again towards the position of closing of the servo valve 5. There hence occurs a second impact with corresponding rebound, and so forth so that a train of rebounds of decreasing amplitude is generated, as indicated by the dashed line in FIG. 9.

Instead, since the armature has the clearance G with respect to the flange 24, after a certain time from the first impact of the open/close element 47 against the connector 49, the armature 17 continues its travel towards the valve body 7, recovering the play existing in the housing A, until an impact of the plane surface 57 of the portion 56 occurs against the shoulder 62 of the bushing 41. As a result of this impact, and also on account of the greater momentum of the armature 17, due to its stroke C of greater length than the stroke I, the rebounds of the bushing 41 reduce sensibly or even vanish. In any case, the way with which the first rebound is modified, as compared to the case where the armature 17 is fixed with respect to the bushing of the open/close element, determines re-opening or otherwise of the servo valve 5 and consequently prolonging of the pilot injection. A lack of re-opening of the servo valve 5 in the instant immediately after the pilot fuel injection—and before the main fuel injection—decreases the likelihood of obtaining a humped injection profile.

Figure 9:
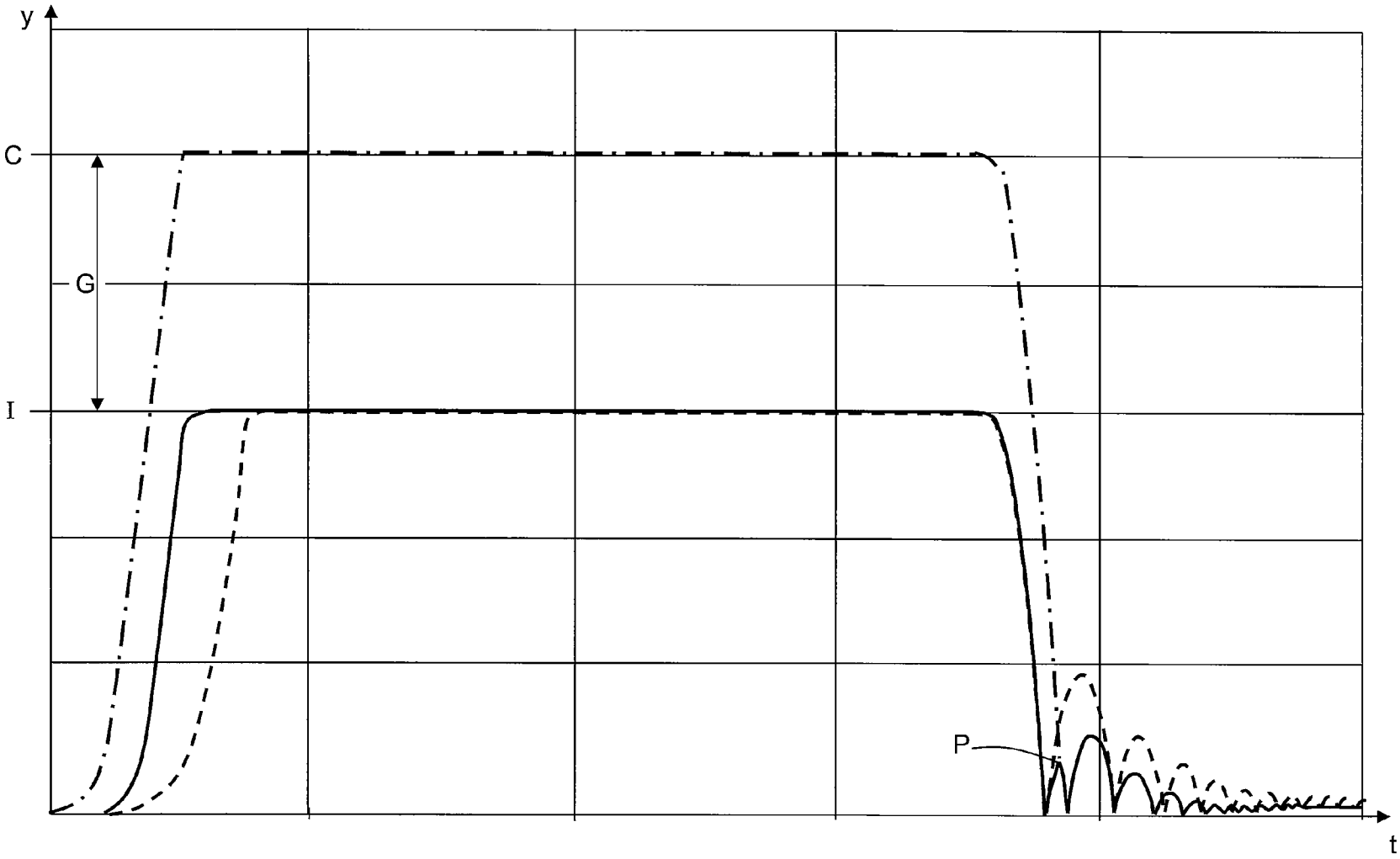
FIGS. 9-11 are comparative diagrams of operation of injectors of FIGS. 1-8.

By appropriately sizing the weights of the armature 17 and of the bushing 41, the stroke C of the armature 17, and the stroke I of the open/close element 47, it is possible to obtain impact of the armature 17 against the bushing 41, represented by point P in FIG. 9, during the first rebound immediately after de-energization of the electromagnet 16, blocking the first rebound so that also the subsequent rebounds prove to be of smaller amplitude. In this case, there is no re-opening of the servo valve 5, or in any case the flow rate of fuel that is discharged by the servo valve 5 during the train of rebounds does not have significant effects on the evolution of the fuel pressure in the control chamber 26, and consequently the rod 10 does not stop its rising stroke, leading to closing of the nebulizer before the command for the main fuel injection.

Figure 10:
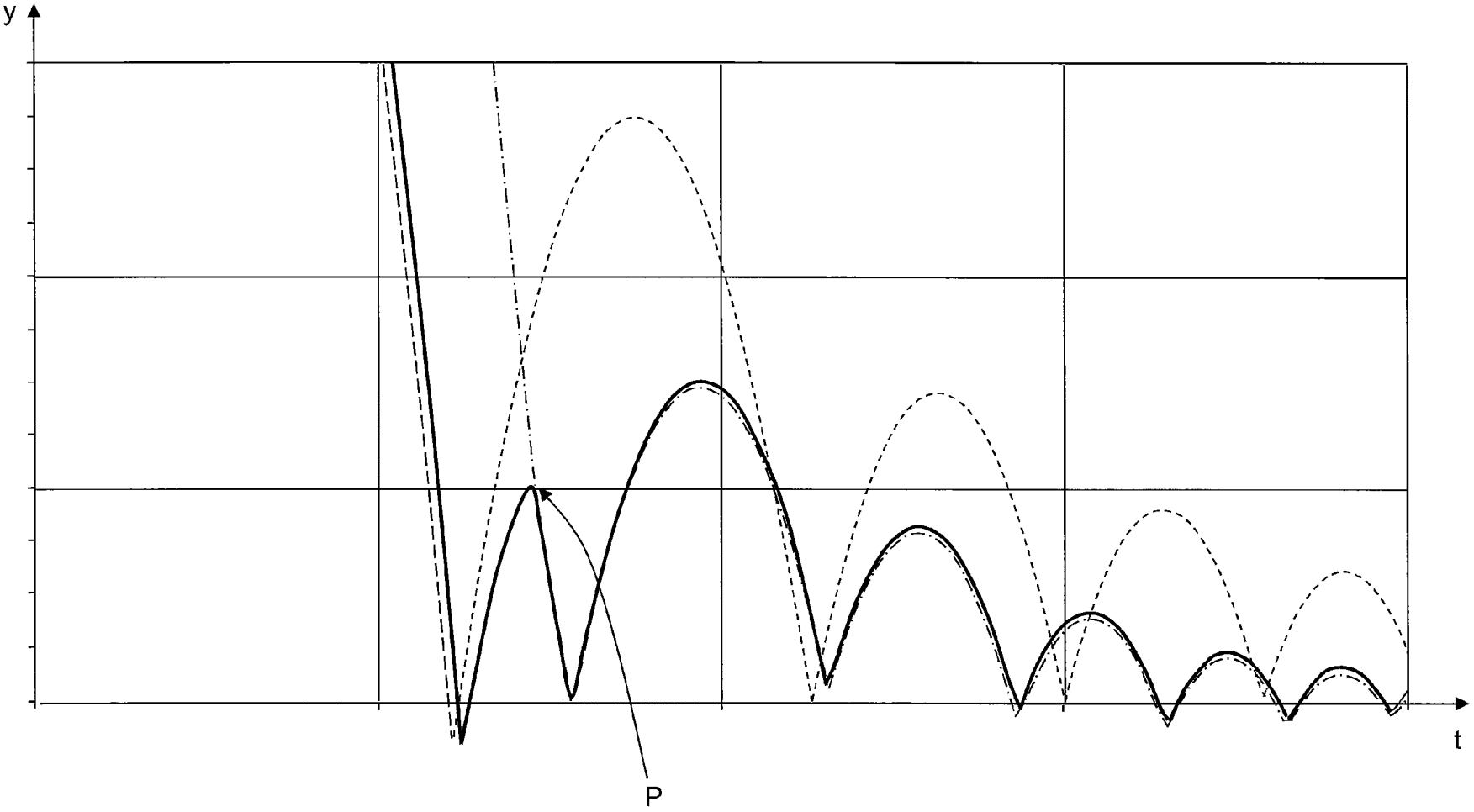

FIGS. 9 and 10 show the diagrams of operation of the servo valve 5 of FIGS. 1-3, as compared with operation of a servo valve according to the known art. In FIG. 9, indicated with a solid line, as a function of time t, is the displacement of the open/close element 47 separate from the armature 17, with respect to the valve body 7. Both the armature 17 and the bushing 41 have each been made with a weight around 2 g. The value "I", indicated on the axis Y of the coordinates, represents the maximum stroke I allowed for the open/close element 47. On the other hand, the travel of an open/close element according to the known art is indicated with a dashed line: in such element, the armature is fixed with respect to or is made of a single piece with the bushing, and the total weight is in the region of 4 grams (g). The two diagrams are obtained by displaying the effective displacement of the open/close element 47. From the two diagrams it emerges that, mainly on account of the fact that the armature 17 is separate from the bushing 41, the motion of opening of the open/close element 47 occurs with a prompter response as compared to the motion of opening of the open/close element 47 according to the known art.

As is highlighted in FIGS. 9 and 10, at the end of the motion in the case of the known art, the open/close element 47 performs a series of rebounds of decreasing amplitude, of which the amplitude of the first rebound is decidedly considerable. Instead, for the open/close element 47, on account of the impact P, the amplitude of the first rebound proves reduced to approximately one third that of the known art. Also the subsequent rebounds are damped more rapidly.

In FIG. 9, indicated with a dashed-and-dotted line is the displacement of the armature 17, which performs, in addition to the stroke I of the open/close element 47, an over-stroke equal to the clearance G between the armature 17 and the flange 24. On the axis Y, the value "C" given is equal to the maximum axial stroke C allowed for the armature 17. Towards the end of the stroke C of closing of the armature 17, at the instant represented by point P, the armature 17 impacts against the shoulder 62 of the bushing 41, whilst this performs the first rebound so that the bushing 41 is pushed by the armature 17 towards the closing position. From the instant of this impact onwards, the armature 17 remains substantially in contact with the shoulder 62, oscillating together with the bushing 41 without managing to re-open the solenoid valve 5, thus preventing the control chamber 26 from emptying suddenly.

The diagrams of FIG. 9 are shown in FIG. 10 at a very enlarged scale, substantially starting from the stretch in which the first rebound occurs. In this way, alteration of the variation envisaged for the fuel pressure in the control chamber 26, and hence delay of closing of the rod 10 for controlling closing of the nebulizer, is reduced or eliminated. Hence, in this case, the injection profile cannot be humped, unless a very short value is chosen for the interval that elapses between the command for the pilot fuel injection and the command for the main fuel injection, but this would be incompatible with the robustness of operation of the injector.

In general, given the same stroke I of the open/close element 47, the greater the clearance G between the armature 17 and the flange 24, the greater the delay of its travel with respect to that of the bushing 41 so that the dashed-and-dotted line of FIG. 10 shifts towards the right. The degree of the first rebound of the open/close element 47 proves greater as long as the point P of impact occurs during the re-opening travel of the open/close element 47. Instead, if the clearance G between the armature 17 and the flange 24 is smaller within certain limits, at the first rebound of the open/close element 47, the shoulder 62 immediately encounters the armature 17. This can hence be drawn along, reversing its motion and exerting a reaction against the spring 23. In this case, the train of rebounds subsequent to the first rebound could be longer in time. However, also these subsequent rebounds prove to be very attenuated, i.e., of a much smaller degree, so that they are unable to bring about a decrease in fuel pressure in the control chamber 26.

Figure 11:
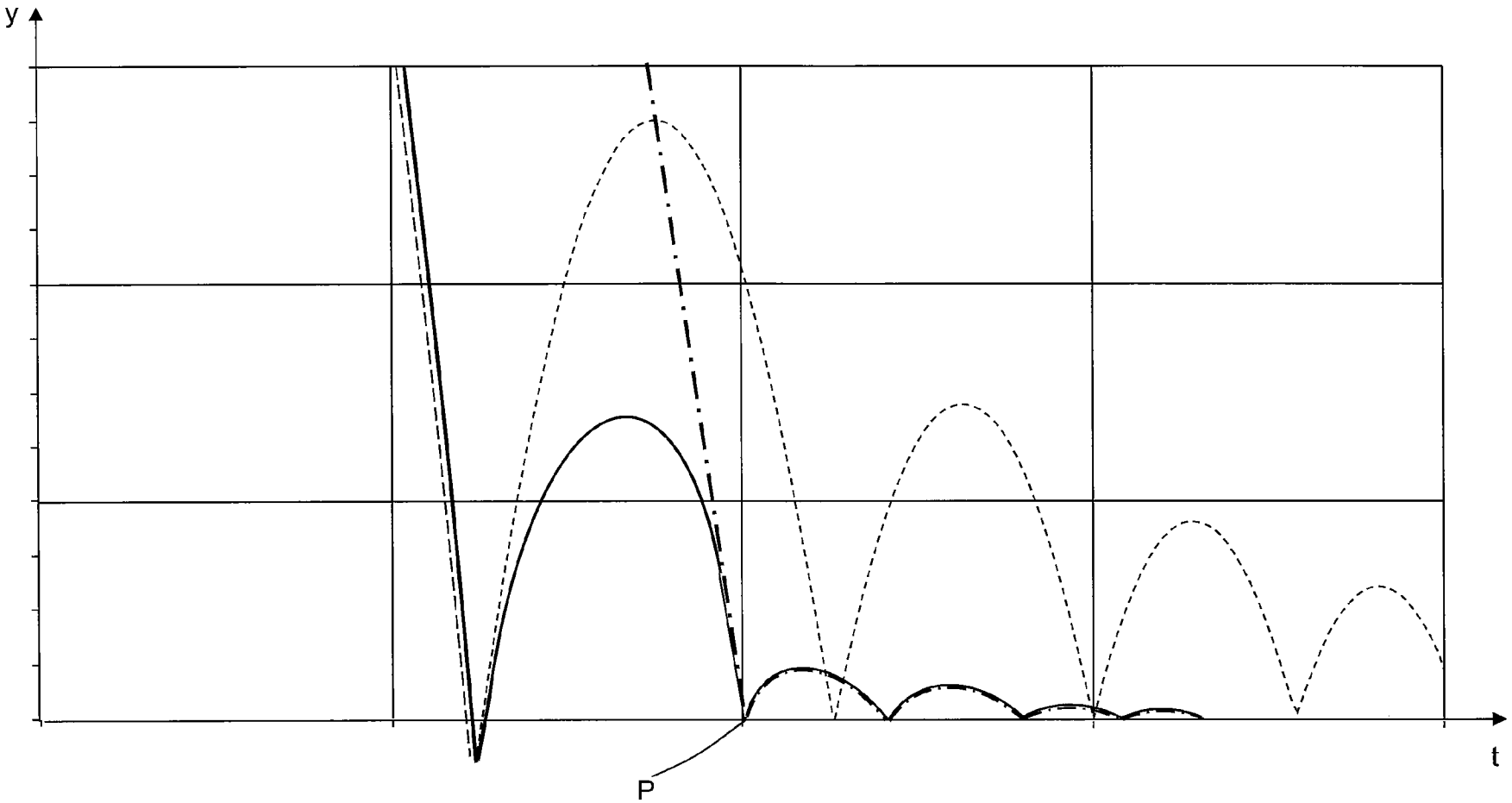

The stroke of the armature 17 and of the open/close element 47 can be chosen so that the impact of the armature 17 with the shoulder 62 occurs exactly at the instant in which the open/close element 47 recloses the solenoid valve 5 after the first rebound, i.e., at the instant in which the point P coincides with the end of the first rebound, as indicated in the diagram of FIG. 11. For said purpose, in the case of the injector of FIGS. 1-3 described above, assuming that the open/close element 47 has a sealing diameter of approximately 2.5 mm, that the pre-loading of the spring 23 is approximately 50 N and the stiffness thereof is approximately 35 N/mm, and that the total weight of the armature 17 and of the bushing 41 is approximately 2 g, the lift I of the open/close element 47 can be comprised between 18 and 22 μm, the clearance G may be approximately 10 μm, so that the stroke C will be comprised between 28 and 32 μm. Consequently, the ratio C/I between the lift C of the armature 17 and the lift I of the open/close element 47 can be comprised between 1.45 and 1.55, whilst the ratio I/G between the lift I and the clearance G can be comprised between 1.8 and 2.2.

From the FIG. 11 it emerges that the maximum value of the first rebound in the case of the armature 17 separate from open/close element 47 (solid curve) is in any case smaller than the maximum value of the first rebound in the case of the armature 17 fixed with respect to open/close element (dashed curve), on account of the lower inertia of the open/close element itself.

In this way, the degree of the first rebound of the open/close element is such as to enable a re-opening of the servo valve 5 with a fuel flow rate such as to stop the increase in pressure in the control space and hence such as to delay closing of the nebulizer. Consequently, by choosing an appropriate value for the time interval after which the command for the main fuel injection is to be issued, it is possible to obtain a humped fuel injection profile.

Since the degree of the rebound allowed is in any case smaller than in the case of the known art, and since the train of further rebounds is practically annulled, the wear of the parts that are in contact or that slide in relative motion manifests with much longer times, consequently increasing the robustness of operation and the service life of the fuel injector.

In fact, as has been said previously, in the case of the known art the wear of the surfaces 45 and 49, and 40 and 39 affects both the degree of the first rebound and the duration of the train itself. In particular, the wear causes increase in the sealing diameter between the surfaces 45 and 49. Hence, at the moment of impact, unbalancing forces tend to be introduced that favour re-opening (i.e., favour the first rebound), whilst the wear of the surfaces of mutual sliding 39 and 40 significantly reduces the friction between the bushing and the valve body, so favouring prolongation of the train of rebounds. Thanks to some examples described here, by reducing or eliminating the rebounds subsequent to the first rebound and reducing the degree of the first rebound itself, there is a smaller dependence of the behaviour of the servo valve 5 upon the wear of the components. Consequently, the servo valve 5 will present over time a high stability of operation, which, instead, is affected much less by the wear of the servo valve 5.

Figure 12:
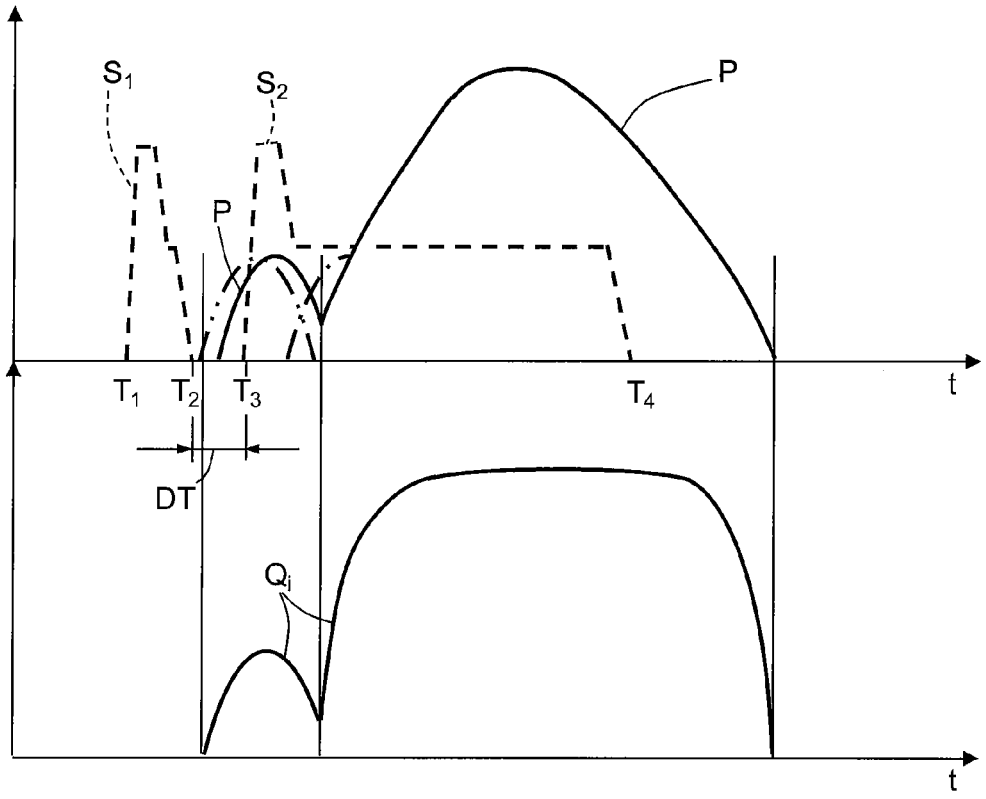
FIGS. 12 and 13 are two diagrams illustrating operation of a fuel injection system according to some examples.
Figure 13:
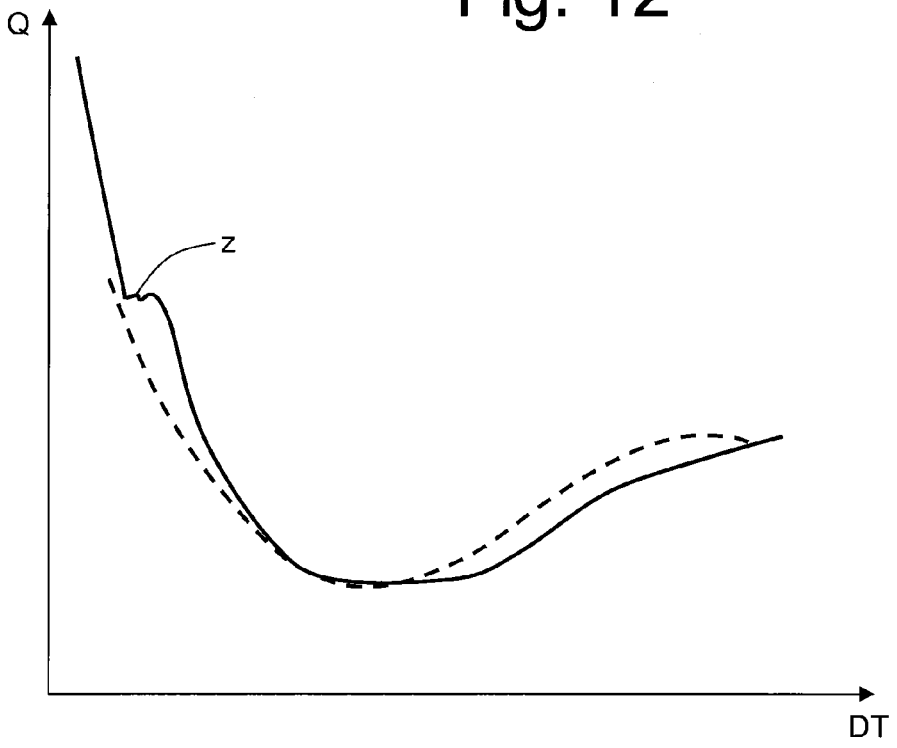

In the present description and in the claims, by the term "command" is understood a signal of electric current having a pre-set duration and a pre-set evolution. FIG. 12 shows a top graph, which represents with a dashed line, as a function of time t, the evolution of the electrical commands S supplied by the control unit 100, and with solid lines the evolution P of the displacement of the rod 10 in response to said commands, with respect to the ordinate "zero", in which the nebulizer of the fuel injector 1 is closed. In addition, FIG. 13 shows a graph, which represents, as a function of time t, the evolution Qi of the instantaneous flow rate of injected fuel in response to the corresponding displacement P of the rod 10.

In order to obtain a good efficiency of the engine and to reduce the emissions of pollutant exhaust gases, for each cycle of a cylinder of the engine, the control unit 100 controls the injector 1 for a fuel injection phase or event, comprising a pilot fuel injection and a subsequent main fuel injection. In certain instances, in order to optimize the fuel injection phase, it has been experimentally found that the main injection should start without a solution of continuity with the pilot fuel injection, i.e., that the fuel injection phase has a humped evolution. In certain instances, in order to optimize the fuel injection phase, it has been experimentally found that the main injection should start without any solution of continuity with the pilot fuel injection, i.e., that the fuel injection phase has a humped evolution.

For the above purpose, for each fuel injection phase, the control unit 100 issues at least one first electrical command $S_1$ of a pre-set duration, for actuating the open/close element 47 thus determining the corresponding pilot fuel injection, and a second electrical command $S_2$ of a duration corresponding to the operating conditions of the engine for actuating the open/close element 47 determining a corresponding main fuel injection. The two electrical commands $S_1$ and $S_2$ are separated by a dwell time DT, which will be seen more clearly in what follows. With reference to FIG. 12, the control unit 100 can be pre-arranged for actuating the electromagnet 16 with a first electrical command $S_1$ so as to cause the rod 10 to perform a first displacement of opening for controlling the pilot fuel injection, and with a second electrical command $S_2$ so as to cause the rod 10 to perform a second displacement of opening for controlling the main fuel injection.

In particular, the first electrical command $S_1$ is generated starting from an instant $T_1$, and has an evolution with a rising edge having a relatively fast growth up to a maximum value in order to energize the electromagnet 16. The duration of the maximum value of the electrical command $S_1$ is constant and is followed by a stretch of maintenance of energization of the electromagnet 16 of an extremely short duration. The stretch of maintenance of the electrical command $S_1$ is finally followed by a stretch of final decrease that terminates in the instant $T_2$.

The second electrical command $S_2$ is generated starting from an instant $T_3$ such as to start the second lift, before the rod 10 has reached the end-of-travel position of closing of the nebulizer. Time $T_3$-$T_2$ constitutes the aforesaid dwell time DT between the two electrical commands $S_1$ and $S_2$.

The second electrical command $S_2$ has likewise an evolution with a rising edge up to a maximum value, in order to energize the electromagnet 16, followed by a stretch of maintenance of energization of the electromagnet 16 of a duration greater than the stretch of maintenance of the first electrical command $S_1$ and variable as a function of the operating conditions of the engine. Finally, the stretch of maintenance of the first electrical command $S_1$ is followed by a stretch of final decrease that terminates at the instant $T_4$.

As may be noted, the motion of the rod 10 occurs with a certain delay with respect to issuing of the corresponding electrical command, which depends upon the pre-loading of the spring 23 (see also FIG. 1). In order to obtain the humped evolution of the instantaneous fuel flow rate Qi, the dwell time DT should be smaller than the duration of the lift of the rod 10 caused by the first electrical command S1 in the case where said signal is isolated. In this way, the lift of the rod 10 caused by the second electrical command $S_2$ starts before the rod 10 returns into the closing position. In certain instances, the evolution Qi of the instantaneous fuel flow rate obtained hence has two consecutive portions without a solution of continuity over time so that the evolution Qi approximates in a satisfactory way the desired, humped, fuel flow rate curve. In certain instances, the evolution Qi of the instantaneous fuel flow rate obtained hence has two consecutive portions without any solution of continuity over time so that the evolution Qi approximates in a satisfactory way the desired, humped, fuel flow rate curve.

Advantageously, the bottom limit of the dwell time DT can be chosen in such a way that the lift of the rod 10 caused by the second electrical command $S_2$ starts from the instant corresponding to the highest point of the lift of the rod caused by the first electrical command $S_1$. Said limit is in the region of 100 μs. In turn, the upper limit of the dwell time DT can be chosen in such a way that the lift of the rod 10 due to the second electrical command $S_2$ starts exactly at the instant in which the rod 10 returns in the closing position following upon the lift due to the first electrical command $S_1$. In FIG. 12, indicated with a dashed-and-dotted line is the evolution of the displacement of the rod 10 at a point corresponding to the bottom limit of the dwell time DT, whilst indicated with a line with dashes and two dots is the evolution of the displacement at a point corresponding to the upper limit of DT.

For each injection phase, the unit 100 can issue more than one first electrical command $S_1$. Said electrical commands can be separated by respective dwell times DT that can be equal to or different from one another, but comprised within the above limits indicated for said interval so that the evolution of the instantaneous fuel flow rate Qi does not present discontinuities.

As has been seen before, the displacement of the rod 10 is caused by a reduction of the fuel pressure in the control chamber 26. By bringing about displacement of the rod 10 by means of the electrical commands $S_1$ and $S_2$ spaced apart by the dwell time DT, the other conditions remaining the same, as said dwell time DT varies, the total amount of injected fuel Q for each fuel injection phase (pilot fuel injection+main fuel injection) varies. In FIG. 13, indicated with dashed line is the variation in the total amount of injected fuel Q as a function of the dwell time DT, in the case where the rebounds of the open/close element 47 are damped as indicated in FIG. 10 and hence are such as to not cause a significant re-opening of the servo valve 5. This is due also to the high gradient of the fuel flow rate introduced only for very small values of the parameter DT. Consequently, in the case where the first rebound is damped, with the modalities described by FIGS. 9 and 10, it is not possible to identify any value for the dwell time DT so as to enable a humped injection profile and guaranteeing stability of operation of the fuel injector. It is to be noted that for larger values of DT the diagram presents a progressive reduction in the total amount of injected fuel Q, which is substantially continuous starting from a dwell time DT of approximately 80 μs up to a dwell time DT of approximately 500 μs.

It has been found experimentally that, by damping the rebounds of the open/close element 47 by means of an impact with the armature 17 during the first rebound as indicated in the diagram of FIG. 10, the total amount of fuel injected in the pilot and main fuel injections drops rapidly as a function of the dwell time DT, with a gradient that is substantially constant up to a dwell time DT of approximately 250 μs. Consequently, an albeit minimum variation of the dwell time DT, which can occur for any reason or be required by the wear of the parts, the value in the amount of injected fuel Q is altered enormously so that there follows a poor repeatability. A possible increase of the pre-loading of the spring 23 of the servo valve 5 could reduce the effect of the attenuation of the rebounds, but would reduce the time of actuation of the open/close element 47, and hence of closing of the nebulizer by the rod 10, but would increase the stress on the parts and hence also the wear.

On the other hand, if the first rebound of the open/close element 47 occurs freely, whilst the further rebounds are blocked as indicated in FIG. 11, the variation in the amount of injected fuel Q as a function of the dwell time DT, within certain limits of the dwell time DT proves to be considerably reduced. A possible variation of the dwell time DT, within said limits of this variation, does not alter sensibly the amount of injected fuel Q so that operation of the fuel injector 1 presents high repeatability and, if an architecture of the armature disengaged from the open/close element, as described previously, is resorted to, is characterized by a marked stability over time.

In FIG. 13, indicated with a solid line is the evolution of the amount of injected fuel Q in the case where the rebounds of the open/close element 47 are damped as indicated in FIG. 11. In this case, the evolution of said quantity has a bent area Z, in which it presents a low variation and is substantially constant. For the injector of FIGS. 1-3 described above, said area Z can be comprised between the values of dwell time DT ranging between 80 and 100 μs, in which the possible variations of the dwell time DT do not substantially cause any variation in the amount of injected fuel Q.

In the embodiments of FIGS. 4-8, the parts similar to those of the embodiment of FIGS. 1-3 are designated by the same reference numbers, and will not be described any further. The diagrams of operation of the servo valve 5 of FIGS. 9-13 have been obtained for the embodiment illustrated in FIGS. 1-3. However, they are well suited to describing, qualitatively, the working principle of the other embodiments.

Figure 4:
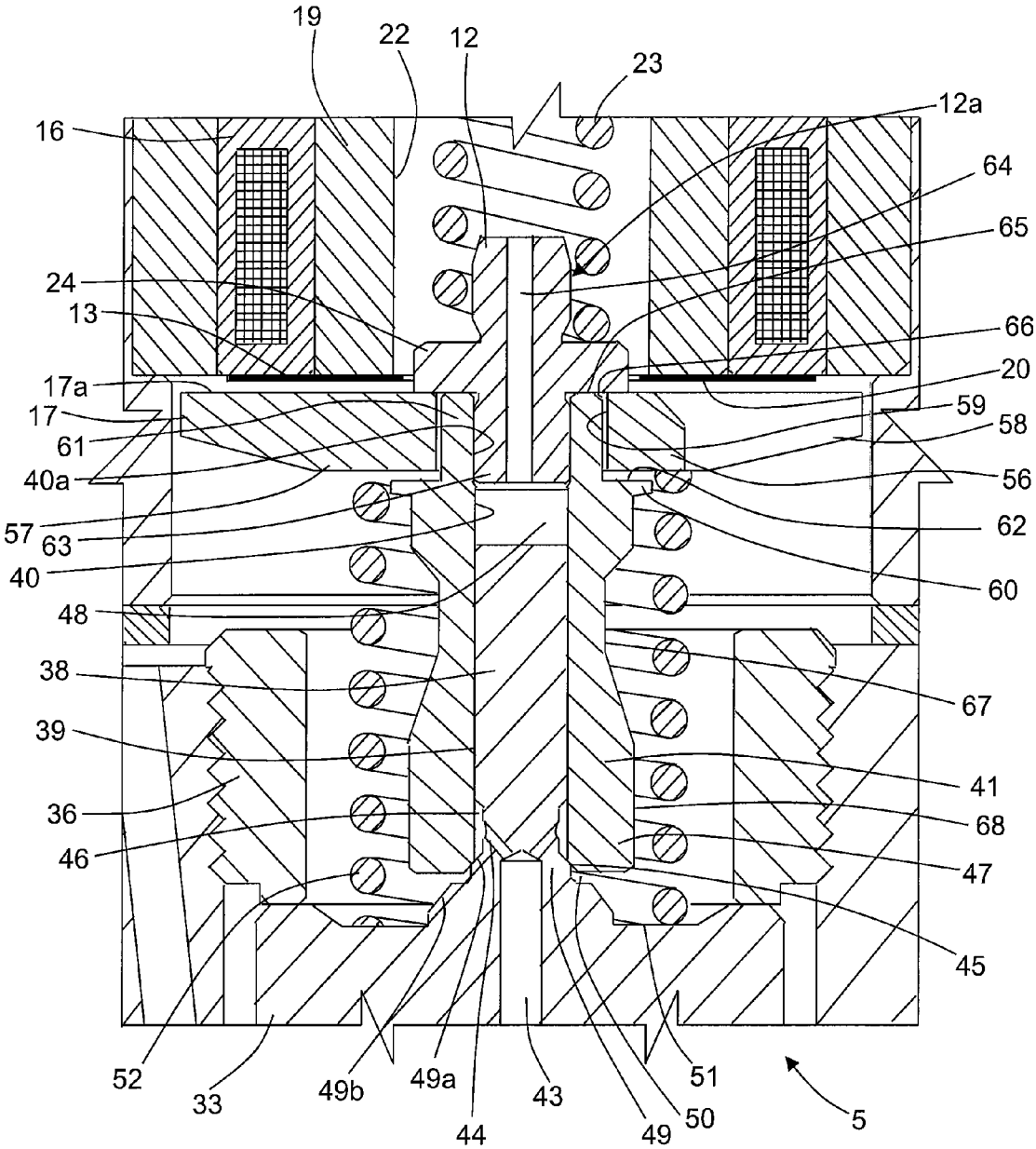
FIG. 4 is a vertical section of the detail of FIG. 2 according to another embodiment.
Figure 5:
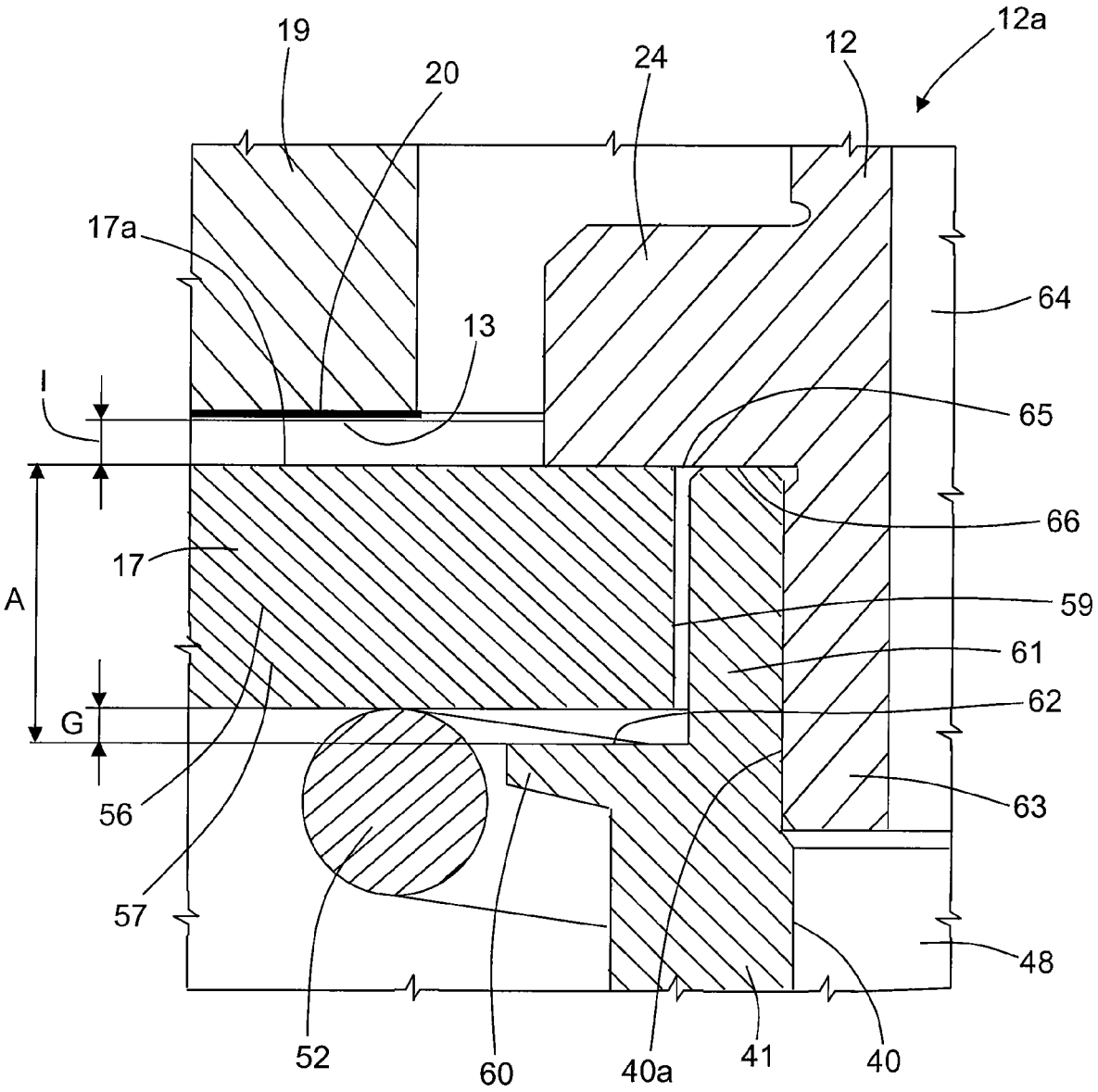
FIG. 5 is a portion of FIG. 4 at a further enlarged scale.

According to the embodiment of FIGS. 4 and 5, in order to reduce the times of opening of the open/close element 47, especially when the fuel injector 1 is supplied at low pressure, a helical compression spring 52 is inserted between the surface 57 of the armature 17 and a depression 51 of the top surface of the flange 33 of the valve body 7. The spring 52 is pre-loaded so as to exert a much lower force than the one exerted by the spring 23, but sufficient to hold the armature 17, with the surface 17*a* in contact with the surface 65 of the flange 24, as indicated in FIGS. 4 and 5.

In order to obtain an operation in which the armature 17 impacts against the shoulder 62 at the end of the first rebound, as illustrated in FIG. 11, the stroke of the open/close element 47 can be comprised between 18 and 22 μm, and the clearance G of the armature 17 can be equal to approximately 10 μm so that also in this case, the stroke C=I+G will be comprised between 28 and 32 μm, the ratio C/I is comprised between 1.45 and 1.55, and the ratio I/G is comprised between 1.8 and 2.2. For reasons of graphical clarity, the strokes I, G and C in FIGS. 1-7 are not in scale with the ranges of the values defined above.

Figure 6:
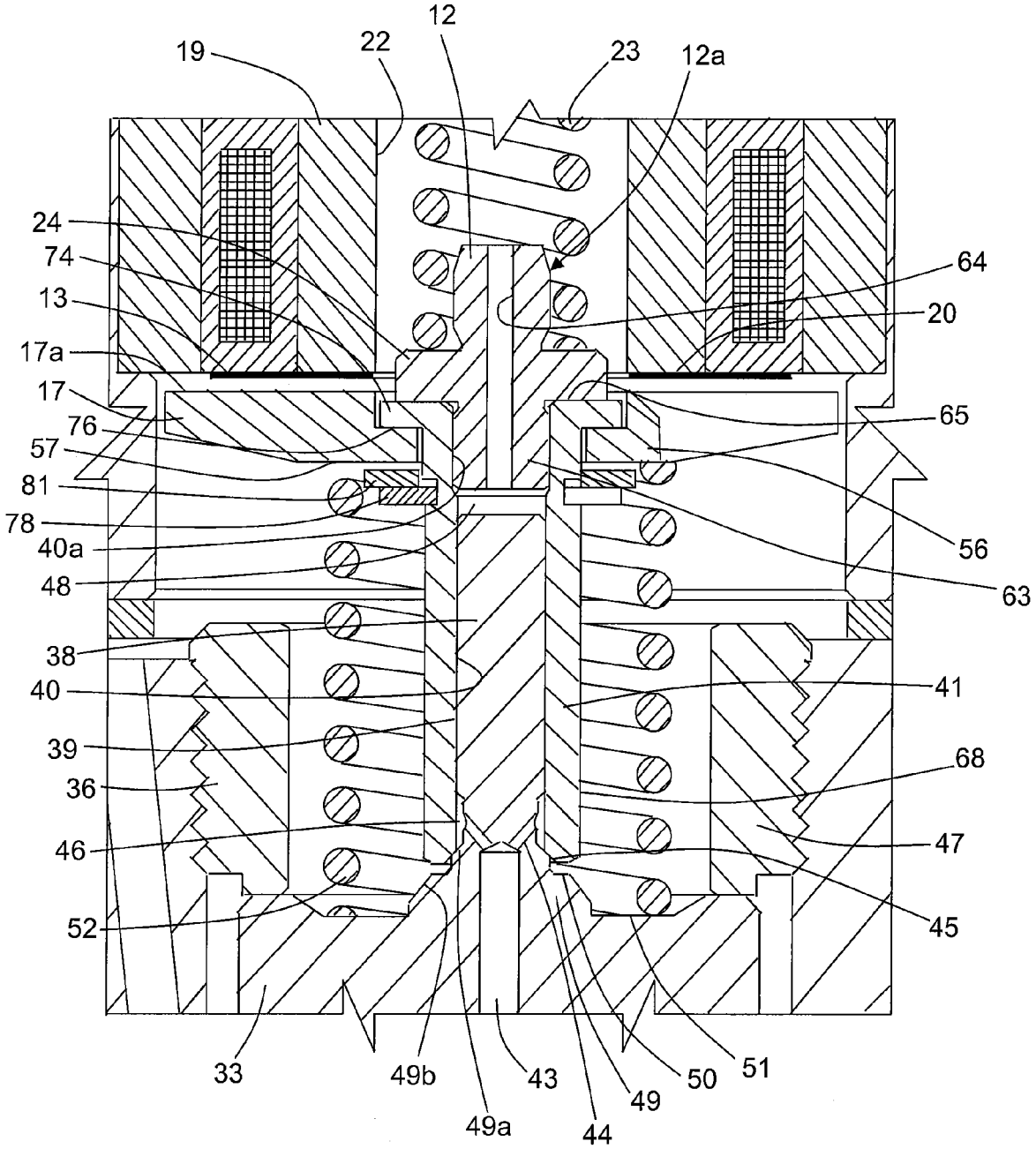
FIG. 6 is a vertical section of the detail of FIG. 2 according to a further embodiment.
Figure 7:
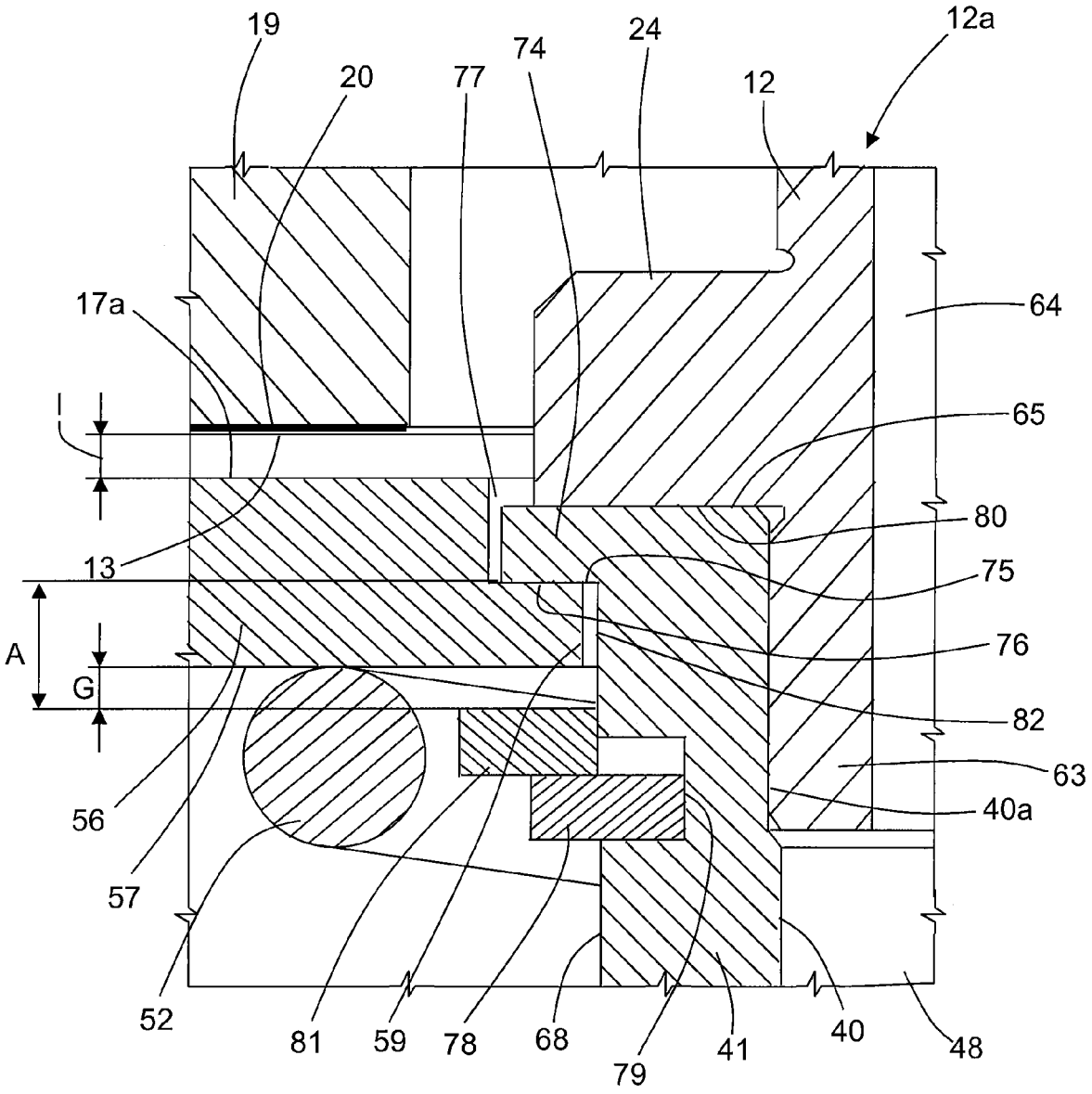
FIG. 7 is a portion of FIG. 6 at a further enlarged scale.

In the embodiment of FIGS. 6 and 7, the means of engagement between the bushing 41 and the armature 17 are represented by a rim or annular flange 74 made of a single piece with the bushing 41. In particular, the rim 74 has a plane surface 75 designed to engage a shoulder 76 formed by an annular depression 77 of the plane surface 17*a* of the armature 17.

The central portion 56 of the armature 17 is here able to slide on an axial portion 82 of the bushing 41, adjacent to the rim 74. In addition, the rim 74 is adjacent to an end surface 80 of the bushing 41, which is in contact with the surface 65 of the flange 24. The annular depression 77 has a depth greater than the thickness of the rim 74 in order to enable the entire travel of the armature 17 towards the core 19 of the electromagnet 16. The shoulder 76 of the armature 17 is normally kept in contact with the plane surface 75 of the rim 74 by the compression spring 52, in a way similar to that has been seen for the embodiment of FIGS. 4 and 5.

Figure 8:
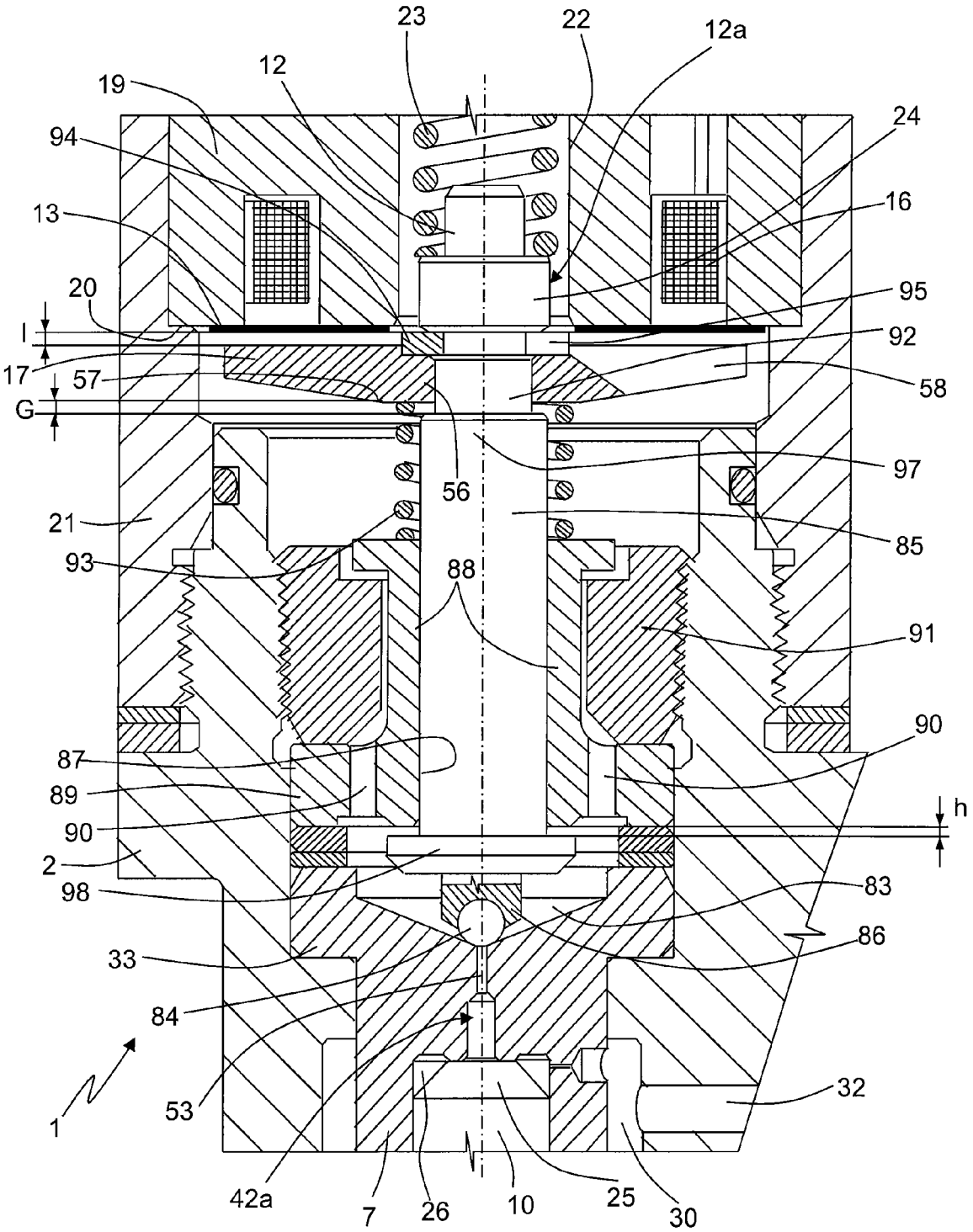
FIG. 8 is a partial vertical section of another type of fuel injector with high stability of operation, according to some examples.

In the embodiment of FIG. 8, the flange 33 of the valve body 7 is provided with a conical depression 83 leading out into which is the calibrated portion 53 of the outlet passage 42*a* of the control chamber 26. The open/close element of this servo valve is constituted by a ball 84, which is controlled by a stem 85, through a guide plate 86. The stem 85 comprises a portion 87 slidable in a sleeve 88, in turn made of a single piece with a flange 89 provided with axial holes 90, which have the purpose of enabling discharge of the fuel from the control chamber 26 towards the cavity 22. The flange 89 is kept fixed against the flange 33 of the valve body 7 by a threaded ring nut 91.

The stem 85 moreover comprises a portion 92 of a reduced diameter on which the armature 17 is able to slide, said armature 17 normally resting by action of a compression spring 93 against a C-shaped ring 94 inserted in a groove 95 of the stem 85. The groove 95 separates the portion 92 of the stem 85 from the end portion 12*a* comprising the flange 24 on which the spring 23 acts and the pin 12 for guiding the end of the spring 23 itself. The spring 23 hence acts on the open/close element 84 through the engagement means comprising the flange 24 and the stem 85.

The projection means, designed to be engaged by the surface 57 of the central portion 56 of the armature 17, are constituted by an annular shoulder 97 set between the two portions 87 and 92 of the stem 85. The shoulder 97 is set in such a way as to define, with the bottom surface of the C-shaped ring 94, the housing A of the armature 17. In addition, the shoulder 97 forms, with the surface 57 of the portion 56 of the armature 17 the clearance G of the armature 17.

Instead, the top surface 17*a* of the armature 17 forms, with the lamina 13 on the polar surface 20 of the electromagnet 16, the stroke I of the stem 85, and hence also of the open/close element 84, whilst the stroke C of the armature 17 is formed by the sum of the clearance G and of the stroke I, in a way similar to that has been seen for the embodiment of FIGS. 4 and 5. Finally, the stem 85 has a bottom flange 98 designed to engage the plate 86 after a stroke h greater than the stroke I of the open/close element 84. The flange 98 is designed to be blocked by the flange 89 of the sleeve 88, in the case where the C-shaped ring 94 is removed from the groove 95.

Operation of the servo valve 5 of FIG. 8 is similar to that of the embodiment of FIGS. 4 and 5 and will not be repeated here. In the closing travel of the open/close element or ball 84, this is subject to the rebounds together with the plate 86 and the stem 85. The armature 17 impacts, then, against the shoulder 97 of the stem 85, hence damping or eliminating the rebounds thereof.

In the particular case of the fuel injector of FIG. 8, which has the open/close element 84 that is spherical with a diameter of approximately 1.33 mm, and a sealing diameter of 0.65 mm, with the weight of the armature of approximately 2 g, the weight of the stem 85 of approximately 3 g, the pre-loading of the spring 23 of 80 N, and the stiffness thereof of 50 N/mm, it is possible to obtain an operation according to the diagram of FIG. 11 with a stroke I of the open/close element 84 comprised between 30 and 45 μm. Assuming also here a clearance G equal to approximately 10 μm, a stroke C is obtained comprised between 40 and 55 μm so that the ratio C/I can be comprised between 1.2 and 1.3, whilst the ratio I/G can be comprised between 3 and 4.5. Also in the case of FIG. 8, for reasons of graphical clarity, the strokes I, G, and C are not in scale with the ranges of the values defined.

From what has been seen above, the advantages of the fuel injection system according to the some examples, as compared to those of the known art are evident. In the first place, the choice of the dwell time DT in such a way that the main fuel injection starts in the area Z of the diagram of FIG. 13, guarantees, within the limits indicated above, a high repeatability of operation of the fuel injector 1. The armature 17, separate from the open/close element and displaceable irrespective thereof, enables reduction or elimination of the rebounds of the open/close element at the end of the closing stroke, significantly reducing the wear of the components of the servo valve. In particular, by appropriately sizing the stroke of the armature 17 and of the open/close element, the impact of the armature 17 against the open/close element at the end of the first rebound makes it possible to eliminate the train of rebounds subsequent to the first rebound and to obtain an area Z in which the variation in the amount of injected fuel is limited so that stability over time of operation of the fuel injector is increased.

It emerges clearly that other modifications and improvements may be made to the fuel injection system described and to the corresponding fuel injector 1, without thereby departing from the scope of the present subject matter. In particular, the fuel injector 1 can be provided with a servo valve 5 of a balanced type, in which the armature 17 moves fixedly with the open/close element 47, for example causing the stroke C of the armature 17 to coincide with the stroke I of the open/close element 47 or making the open/close element of a single piece with the armature 17. In this case, the open/close element 47, when the servo valve 5 closes, performs freely the first rebound so that, with a dwell time DT substantially within the limits indicated above, there is generated, in the diagram of FIG. 13 representing the amount of injected fuel Q, an area Z, in which the variation of said amount Q is minimum.

The invention claimed is:

1. A fuel injection system, with high operational repeatability and stability, for an internal combustion engine, comprising:

at least one fuel injector to be controlled by a metering servo valve, the at least one fuel injector including a control chamber to be supplied with fuel and including an outlet passage to be opened or closed by an open/close element cooperating with a corresponding valve seat;

an urging member to urge the open/close element into engagement with the valve seat in a valve closing position;

an electric actuator including an armature to act on the open/close element against the action of the urging member to open the outlet passage; and a control circuit to control the electric actuator to supply, in a fuel injection phase, at least a first electric command to actuate the open/close element to inject a pilot fuel injection, and a second electric command to actuate the open/close element to inject a main fuel injection, the first and second electric commands separated in time by an electric dwell time chosen to cause the main fuel injection to start without a solution of continuity with the pilot fuel injection;

wherein the open/close element initially engages the armature as the open/close element is urged into engagement with the valve seat by the urging member to urge the armature toward a closed position, the open/close element releasing the armature as the armature moves toward the closed position such that the armature impacts the open/close element after the open/close element engages the valve seat to limit rebounding of the open/close element from engagement of the open/close element to the valve seat such that an amount of fuel injected during the pilot and main fuel injections in a fuel injection phase is substantially constant during the electric dwell time.

2. The fuel injection system according to claim 1, wherein the electric dwell time is between about 80 to about 100 microseconds (μs).

3. The fuel injection system according to claim 2, wherein the urging member is sized such that the open/close element is to complete a closing stroke with a pre-set delay with respect to the end of the relevant electric command.

4. The fuel injection system according to claim 1, wherein the electric actuator includes an armature that is displaced fixedly with the open/close element.

5. The fuel injection system according to claim 1, wherein the open close element is separate from the armature and is to engage the valve seat through a preset closing stroke to the valve closing position, the armature to follow an axial stroke greater than the closing stroke to reduce the rebounds in number.

6. The fuel injection system according to claim 5, wherein the armature is to be brought into the closing position so as to impact the open/close element with a delay to oppose rebounds of the open/close element against the valve seat.

7. The fuel injector system according to claim 6, wherein the armature impacts the open/close element as the open/close element returns to the closing position after a first rebound after a first rebound so as to eliminate subsequent rebounds of the open/close element.

8. The fuel injection system according to claim 6, wherein the servo valve has a valve body comprising the control chamber and provided with a calibrated inlet for the fuel, and wherein the armature is arranged to be guided axially by a corresponding guide element along the axial stroke, and the urging member is to act on the open/close element through a flange.

9. The fuel injection system according to claim 8, wherein the axial stroke is between 18 and 60 μm, the difference between the axial stroke and a clearance being equal to the closing stroke.

10. The fuel injection system according to claim 9, wherein the guide element axially guides a bushing made of a single piece with the open/close element, the servo valve including a valve body comprising an axial stem to guide the bushing, the outlet passage of the control chamber comprising a discharge duct carried by the axial stem, the discharge duct comprising at least one substantially radial portion that extends out a side surface of the stem, the bushing slidable between a position of closing and a position of opening of the radial portion.

11. The fuel injection system according to claim 10, wherein the guide element is provided with shoulders coupled to the bushing in a position such that, upon operation of the electric actuator, they are impacted axially by the armature.

12. The fuel injection system according to claim 11, wherein the flange is formed by a flange of an intermediate body rigidly connected to the bushing.

13. The fuel injection system according to claim 1, wherein the electric dwell time is chosen to cause the main fuel injection to start without any solution of continuity with the pilot fuel injection.

14. The fuel injection system according to claim 1, wherein the electric dwell time is associated with causing the main fuel injection to start without any solution of continuity with the pilot fuel injection.

* * * * *